US008111866B2

(12) United States Patent
Miura et al.

(10) Patent No.: US 8,111,866 B2
(45) Date of Patent: Feb. 7, 2012

(54) STORAGE RACK

(75) Inventors: Koji Miura, Tokyo (JP); Takashi Shima, Kanagawa (JP); Shingo Niinuma, Kanagawa (JP); Toshiki Watanabe, Kanagawa (JP)

(73) Assignee: Sony Corporation, Tokyo (JP)

( * ) Notice: Subject to any disclaimer, the term of this patent is extended or adjusted under 35 U.S.C. 154(b) by 1096 days.

(21) Appl. No.: 11/934,927

(22) Filed: Nov. 5, 2007

(65) Prior Publication Data

US 2008/0122325 A1 May 29, 2008

(30) Foreign Application Priority Data

Nov. 28, 2006 (JP) ..... 2006-320665

(51) Int. Cl.
*H04R 25/00* (2006.01)

(52) U.S. Cl. ..... 381/388; 381/301; 381/333

(58) Field of Classification Search ..... 381/300, 381/301, 303–306, 332–335, 386, 388; 181/144, 181/145, 147, 199
See application file for complete search history.

(56) References Cited

U.S. PATENT DOCUMENTS

| | | | | |
|---|---|---|---|---|
| 3,104,729 | A * | 9/1963 | Olson | 181/145 |
| 3,491,204 | A * | 1/1970 | Sherno | 381/301 |
| 5,005,201 | A * | 4/1991 | Rumreich et al. | 381/306 |
| 7,280,667 | B2 * | 10/2007 | Furuno et al. | 381/386 |

FOREIGN PATENT DOCUMENTS

| | | |
|---|---|---|
| JP | 55-159672 | 11/1980 |
| JP | 2-101675 | 8/1990 |
| JP | 2-126492 | 10/1990 |
| JP | 6-77578 | 11/1994 |
| JP | 7-307908 | 11/1995 |
| JP | 2001-268478 | 9/2001 |
| JP | 2005-303479 | 10/2005 |

* cited by examiner

*Primary Examiner* — Huyen D Le
(74) *Attorney, Agent, or Firm* — Oblon, Spivak, McClelland, Maier & Neustadt, L.L.P.

(57) ABSTRACT

A storage rack capable of storing an audio apparatus is provided. The storage rack includes: a top board portion, at least two leg portions, a shelf board portion, and a speaker storage portion. The top board portion supports the audio apparatus. The at least two leg portions hold the top board portion. The shelf board portion is vertically joined to a side surface of the respective leg portions and in parallel with the top board portion with an adjustable distance thereto. The speaker storage portion is arranged under the shelf board portion. The speaker storage portion is arranged at a position having a predetermined distance in the depth direction of the shelf board portion.

7 Claims, 8 Drawing Sheets

STORAGE RACK

CROSS REFERENCES TO RELATED APPLICATIONS

The present invention contains subject matter related to Japanese Patent Application JP 2006-320665 filed in the Japanese Patent Office on Nov. 28, 2006, the entire contents of which being incorporated herein by reference.

BACKGROUND OF THE INVENTION

1. Field of the Invention

The present invention relates to a storage rack incorporating a speaker such as a subwoofer.

2. Description of the Related Art

An AV (Audio Video) rack incorporating a speaker, an amplifier or the like has been known as a rack capable of mounting or storing a television receiver, an audio apparatus or the like. Lately, home theater systems for enjoying high quality video and audio at home have been widely used. As a result, an amplifier and a speaker provided to such AV rack may correspond to 5.1 or more channels.

Right and left speakers at the front, right and left speakers at the rear, a speaker at the center, and a subwoofer for reproducing sound in bass frequencies alone are provided to establish a 5.1 channel surround sound reproduction environment.

Japanese Unexamined Patent Application Publication No. 2005-303479 discloses a stand provided with a space for mounting a subwoofer.

SUMMARY OF THE INVENTION

A subwoofer is responsible for a 0.1 channel out of the 5.1 channels and produces resonance of the air using a bass reflex duct, thereby reproducing sound of low bass frequencies. Hence, the subwoofer may need a space for the resonance of the air. Accordingly, the subwoofer may be large to some extent so that sound in the bass range is reproduced sufficiently. As a result, in the case of mounting the subwoofer to a storage rack as described above, an appearance of the subwoofer may be noticeable and limit the design thereof.

FIG. 1 is a front view of an exemplified AV rack 200 including a built-in subwoofer according to related art. The AV rack 200 shown in FIG. 1 includes: a top board portion 213 on which a television receiver or the like is mounted, leg portions 212*a*, 212*b* supporting the top board portion 213, and a shelf board 214 extending between the two leg portions 212*a*, 212*b*. Further, a subwoofer storage portion 202 including a subwoofer unit 201 is provided at the right end of the AV rack 200.

As shown in FIG. 1, the subwoofer storage portion 202 occupies a large part of the AV rack 200 and the portion is noticeable, causing a space for storing audio equipment such as a DVD (Digital Versatile Disc) recorder to be reduced. Therefore, as shown in FIGS. 2A and 2B, there has been proposed a storage rack in which the subwoofer unit 201 is provided at the rear. FIG. 2A is a front view of the storage rack 200 and FIG. 2B is a rear view thereof.

As shown in FIG. 2A (front view), the subwoofer storage portion 202 is provided at the left end of the AV rack 200. However, the subwoofer storage portion 202 alone is shown to the user, and the subwoofer unit 201 is not shown to the user. FIG. 2B is a rear view of the AV rack 200, showing the subwoofer unit 201 facing the opposite side to the front side shown in FIG. 2A to which the user faces.

However, in the case where the subwoofer unit 201 is arranged at the rear as shown in FIGS. 2A and 2B, a reproduction frequency band of the subwoofer unit 201 may have less continuity with those of other speakers (not shown in the figures). For improving the continuity between the respective bands while the subwoofer unit 201 is arranged at the rear, a frequency band of sound reproduced from the other speakers than the subwoofer or the subwoofer unit 201 may need to be extended. Although the continuity may be improved by increasing the volume of a speaker storage portion including a speaker, it is not preferable for the AV rack that stores audio equipment to have a large built-in audio device.

It is desirable to provide a storage rack having a speaker such as a subwoofer arranged in a less noticeable position while obtaining a high-quality output sound.

According to an embodiment of the present invention, there is provided a storage rack capable of storing an audio apparatus, including a speaker storage portion and a top board portion supporting the audio apparatus. Further, the storage rack includes at least two leg portions for holding the top board portion and a shelf board portion provided in parallel with the top board portion and vertically joined to side surfaces of the two leg portions. A distance between the shelf board portion and the top board portion is adjustable. Further, the speaker storage portion is suspended from the rear surface of the shelf board portion and arranged at the position having a predetermined distance in the depth direction of the shelf board portion.

Accordingly, a speaker such as a subwoofer is arranged at the rear under the shelf board portion so that it may be less noticeable when viewed from the front of the storage rack.

In the above described case, the speaker storage portion is arranged at the rear in the depth direction of the storage rack. However, since such a member that covers the speaker storage portion is not used, the quality of sound output from the subwoofer or the like can be prevented from being deteriorated.

According to the embodiment, a speaker such as a subwoofer can be provided in a less noticeable position without deteriorating the quality of sound output from the speaker.

DESCRIPTION OF THE PREFERRED EMBODIMENTS

Hereinafter, embodiments of the present invention will be described with reference to FIGS. 3 to 11. The embodiments are applied to an AV rack (storage rack) including an amplifier that amplifies the sound output from a television receiver and an audio apparatus, a speaker unit outputs the sound, a subwoofer unit reproducing the sound in the frequency band of approximately 40 Hz to 200 Hz.

Figure 1:
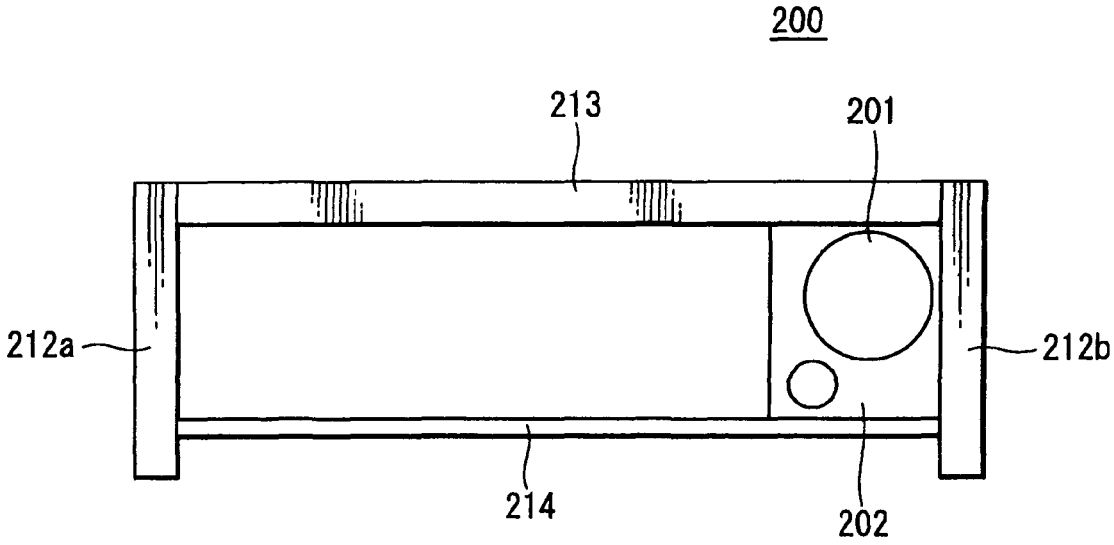
FIG. 1 (RELATED ART)
FIG. 1 is a front view illustrating a structure of an AV rack according to related art.
Figure 2A:
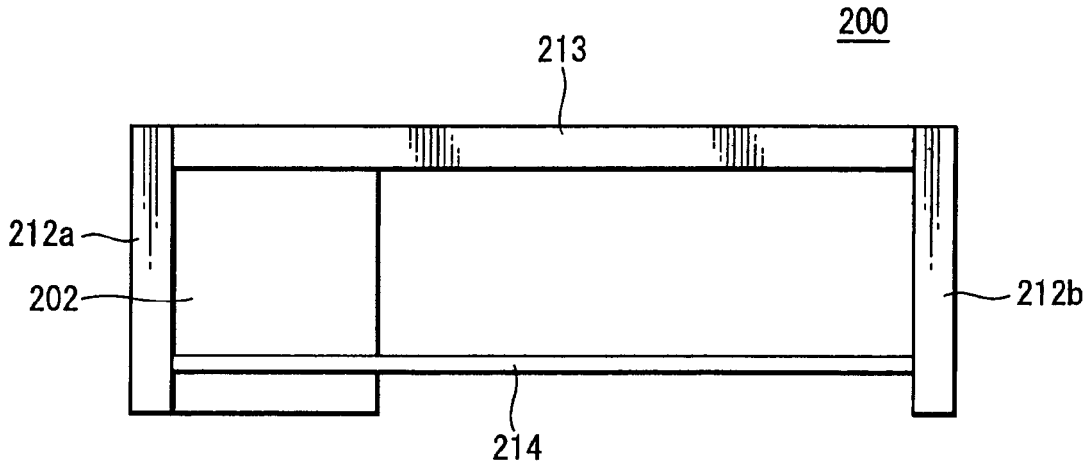
FIG. 2A (RELATED ART)
FIGS. 2A and 2B are a front view and a rear view respectively illustrating a structure of an AV rack according to related art.
Figure 2B:
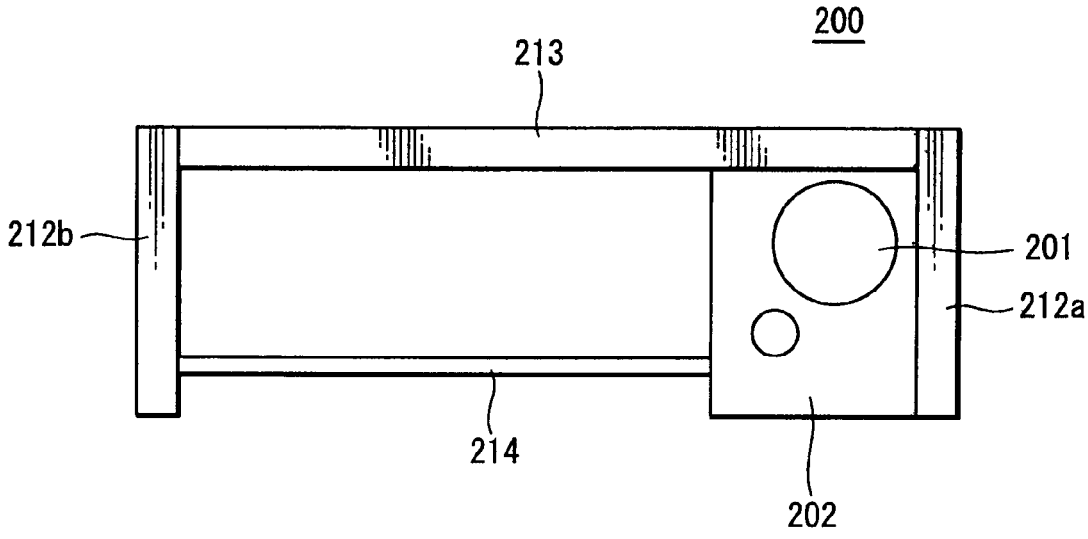
FIG. 2B (RELATED ART)
Figure 3:
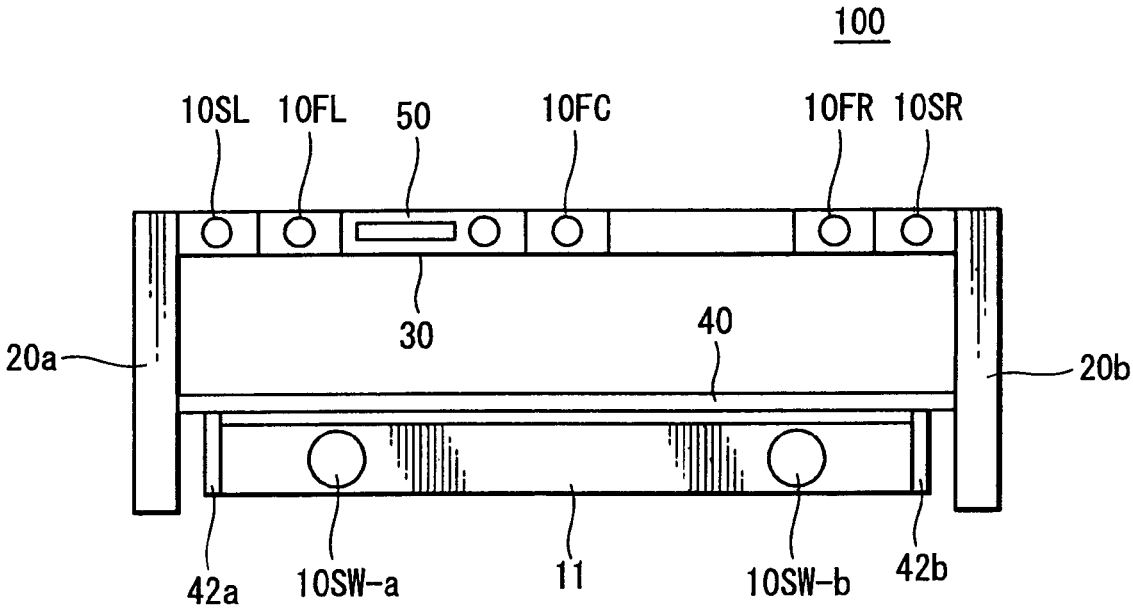
FIG. 3 is a front view illustrating a structure of an AV rack according to an embodiment of the present invention.
Figure 4:
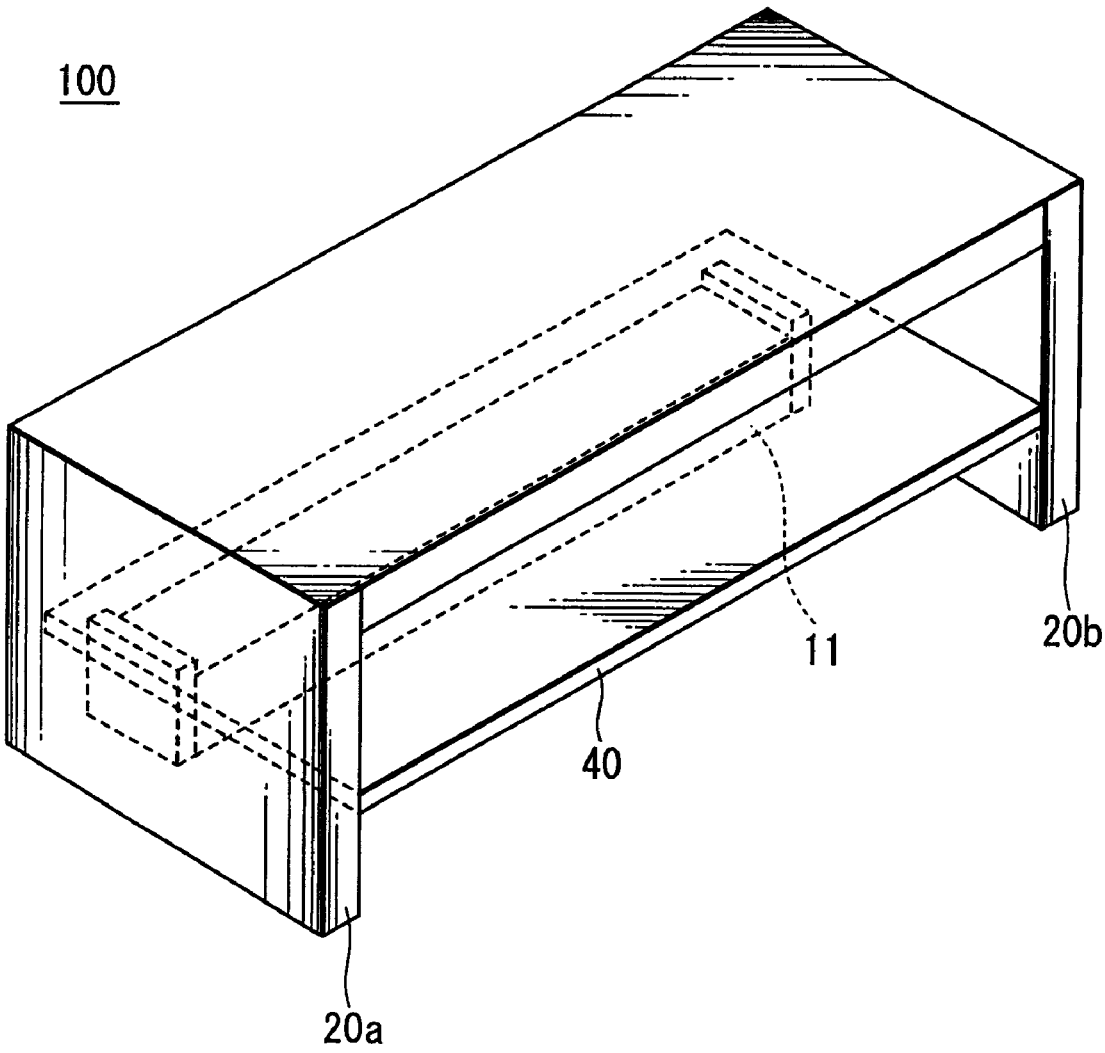
FIG. 4 is a perspective view illustrating a structure of an AV rack according to an embodiment of the present invention.

An AV rack 100 shown in FIG. 3 includes a top board portion 30 on which a television receiver or the like may be arranged and which is held by leg portions 20*a*, 20*b*. A shelf board portion 40 is extended between the leg portions 20*a*, 20*b*. A plurality of shelf-board supports (not shown in the figure) are provided at predetermined intervals on the side surface of the leg portions 20*a*, 20*b* respectively. The height of the shelf board portion 40 can be adjusted by using the shelf-board supports provided at different heights. Under the shelf board portion 40 is provided a subwoofer box (subwoofer storage portion) 11 incorporating subwoofer units 10SW-*a* and 10SW-*b*. The subwoofer box 11 is suspended from the rear (lower) surface of the shelf board portion 40 and held by subwoofer holding portions 42*a*, 42*b*. As arranged under the shelf board portion 40, the subwoofer box 11 is rectangular and has a low height. FIG. 4 is a perspective view of the AV rack 100. As shown in FIG. 4, the subwoofer box 11 is not seen from the outside and the position thereof is indicated with dotted lines.

As shown in FIG. 3, the AV rack 100 according to the embodiment further includes an amplifier 50 that amplifies the sound output from a television receiver arranged on the top board portion 30, an audio apparatus arranged on the shelf board portion 40 and the like, and a speaker unit that outputs the sound amplified at the amplifier 50. The speaker unit includes a left-rear speaker 10SL, a left-front speaker 10FL, a center-front speaker 10FC, a right-front speaker 10FR, and a right-rear speaker 10SR, all of which is arranged within the top board portion 30. In addition to the speaker unit including the above-described speakers, the subwoofer box 11 including the built-in subwoofer units 10SW-*a* and 10SW-*b* is provided under the shelf board portion 40, so that the 5.1 channel surround sound environment can be constructed around the user.

Figure 5:
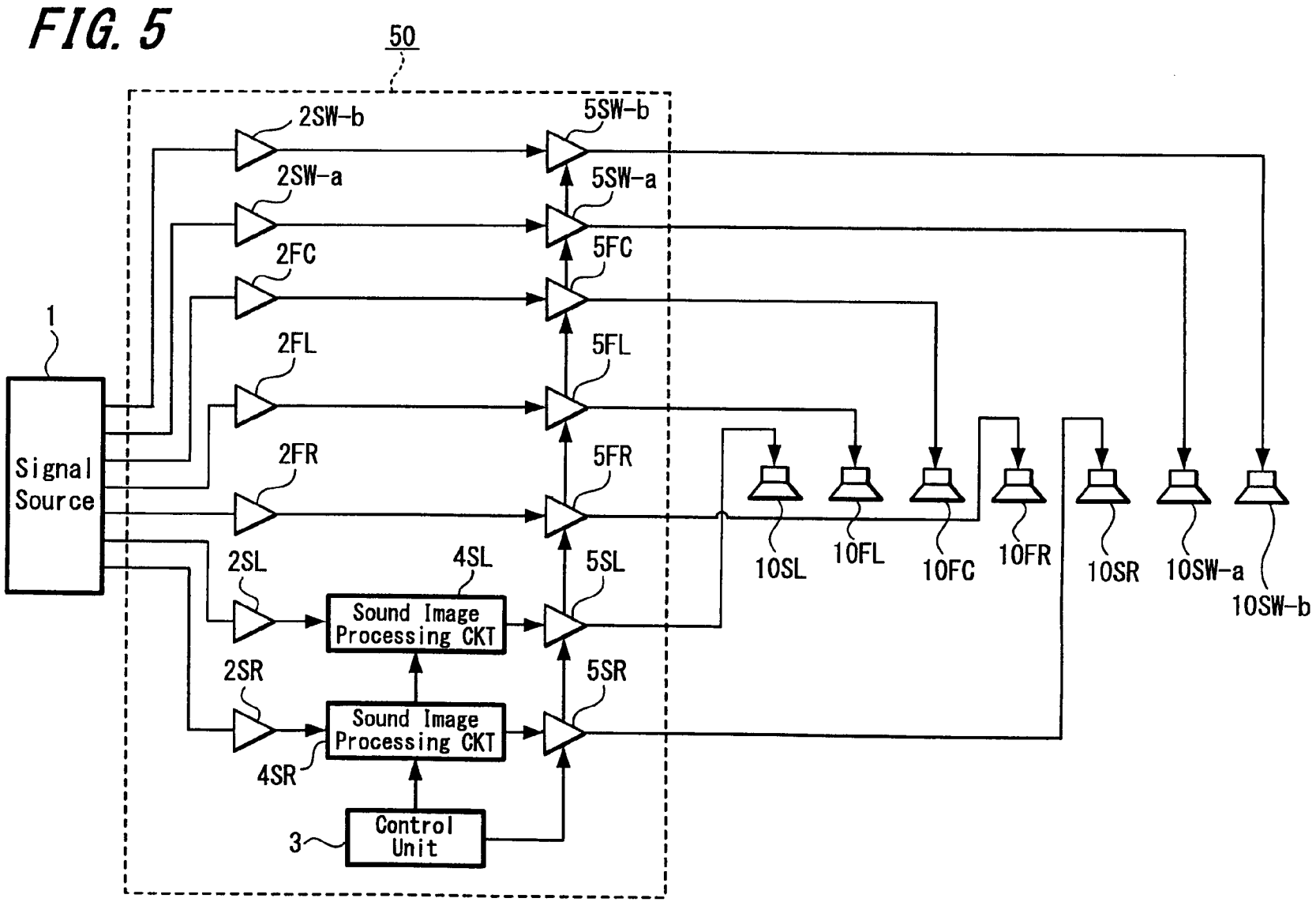
FIG. 5 is a block diagram illustrating an internal configuration of an AV rack according to an embodiment of the present invention.

Next, an internal configuration of the AV rack 100 according to an embodiment of the present invention is described with reference to FIG. 5. A reproduced audio signal output from an audio apparatus or the like is supplied to the amplifier 50 from a signal source 1. In the amplifier 50, an audio signal of a subwoofer left channel, that of a subwoofer right channel, that of a center channel, that of a left-front channel, that of a right-front channel, that of a left-rear channel, and that of a right-rear channel are supplied to preamplifiers 2SW-*b*, 2SW-*a*, 2FC, 2FL, 2FR, and 2SR respectively. Audio signals of the respective channels amplified in the preamplifiers 2SW-*b*, 2SW-*a*, 2FC, 2FL, and 2FR, are supplied to amplifiers 5SW-*b*, 5SW-*a*, 5FC, 5FL, and 5FR and output as sound from the speakers 10SW-*b*, 10SW-*a*, 10FC, 10FL, and 10FR.

Further, audio signals amplified in the preamplifiers 2SL and 2SR for the left-rear channel and right-rear channel are respectively supplied to sound image processing circuits 4SL, 4SR where virtual sound image processing is carried out. Audio signals output from the sound image processing circuits 4SL, 4SR are supplied to the amplifiers 5SL, 5SR and output as sound from the speakers 10SL, 10SR. Processing in the sound image processing circuits 4SL, 4SR, amplification in the amplifiers 5SW-b to 5SR and the like are carried out based on a predetermined operation and control of a control unit 3.

Figure 6:
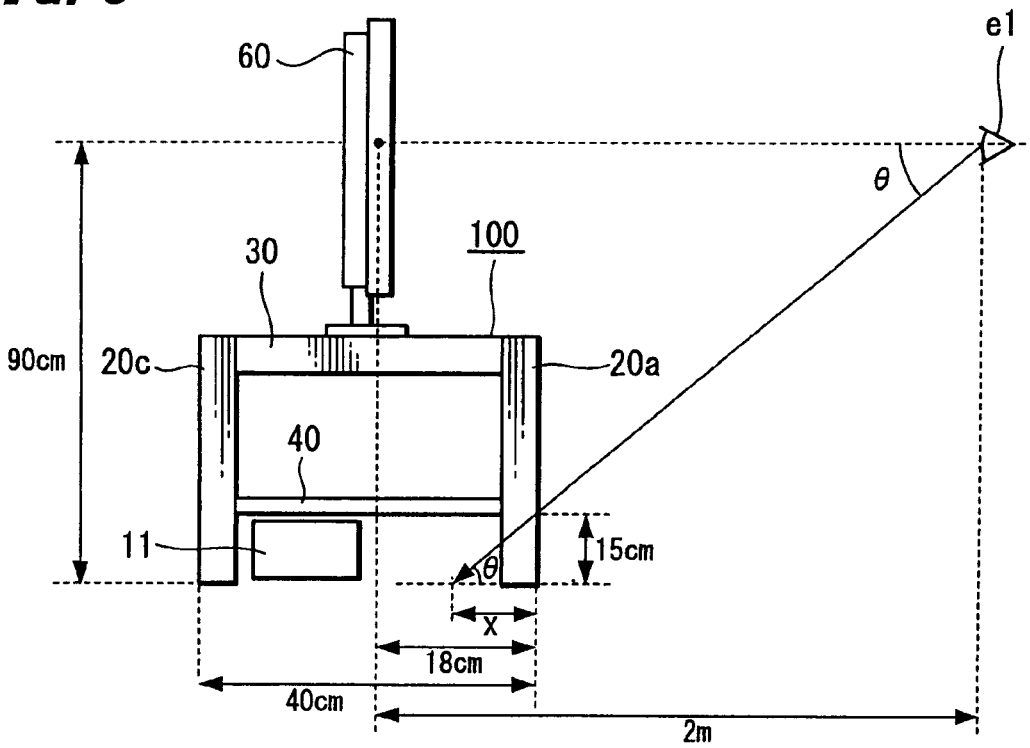
FIG. 6 is a side view illustrating a position to which a subwoofer box is attached according to an embodiment of the present invention.

Next, an example of position where the subwoofer box 11 is attached is described with reference to FIG. 6. FIG. 6 is a side view of the AV rack 100. As shown in FIG. 6, a television receiver 60 is arranged on the top board portion 30 of the AV rack 100 in this example. Here, in FIG. 6, a member covering the side surface of the AV rack 100 is not illustrated in order to show the inside of the AV rack 100.

As shown in FIG. 6, the subwoofer box 11 is arranged at the rear side when viewed from a user e1. The subwoofer box 11 is arranged at the rear side so that the subwoofer box 11 may be less noticeable for the user e1. The position in the depth direction where the subwoofer box 11 is arranged is calculated based on the height of the user's eyes, the distance to the user and the like.

For example, in the case where the height of the user's eyes is 90 cm that corresponds to the sum of the height of the AV rack 100 and half the height of the television receiver 60 and then the distance between the user e1 and the television receiver 60 is 2 m, values described below can be calculated. Specifically, an angle θ formed when the user e1 looks down at the lower part of the shelf board portion 40 can be calculated as about 42° by using the distance (here, 18 cm) between the center position of the television receiver 60 and the front surface of the AV rack 100 and the height (15 cm in this example) of the shelf board portion 40 from the floor level. Further, the distance X reached with the user's eyes can be calculated using such values (in the case where the leg portion 20*a* has the thickness of 5 cm in the depth direction, the distance X is about 11 cm). If the subwoofer box 11 is placed in a position having more distance to the front surface than the calculated distance X, the subwoofer box 11 is not shown to the user e1.

As described above, since the subwoofer box 11 is provided under the shelf board portion 40 in the position having a predetermined distance in the depth direction, the subwoofer box 11 may be not readily shown to the user e1. Accordingly, design limits for the AV rack 100 caused by providing a subwoofer may be eliminated.

Further, the subwoofer units 10SW-*a*, 10SW-*b* are arranged on the front surface facing the user. Therefore, the sound from the subwoofer units 10SW-*a*, 10SW-*b* is directly output in the direction of the user, so that the quality thereof can be maintained.

Further, the respective subwoofer units 10SW-*a*, 10SW-*b* are arranged in the position having the equal distance from the center of the AV rack 100. Hence, out of the frequency band of 40 Hz to 200 Hz output from the subwoofer units 10SW-*a*, 10SW-*b* according to the embodiment, sound in the frequency band of 150 Hz or more, which may have the directivity, can be output in a fine balance.

Figure 7:
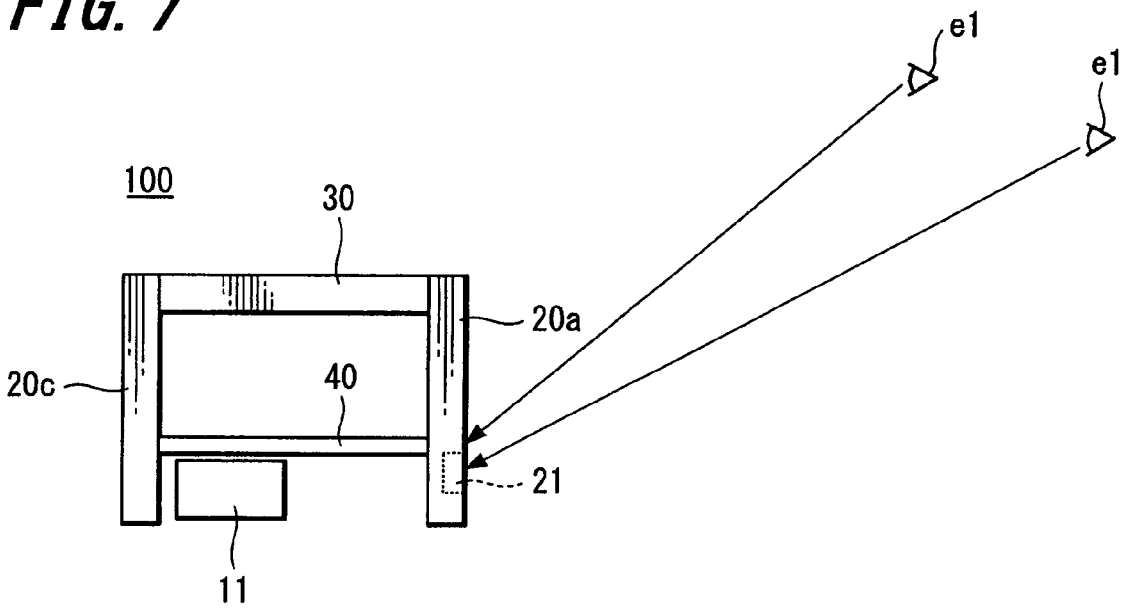
FIG. 7 is a side view illustrating a structure of an AV rack when a blind screen is attached according to another embodiment of the present invention.

In the above-described embodiment, a blind screen 21 may be provided right under the front surface of the shelf board portion 40 as shown in FIG. 7 so that the user e1 may not notice the subwoofer box 11. With such structure, the subwoofer box 11 may be less noticeable for the user e1.

Figure 8:
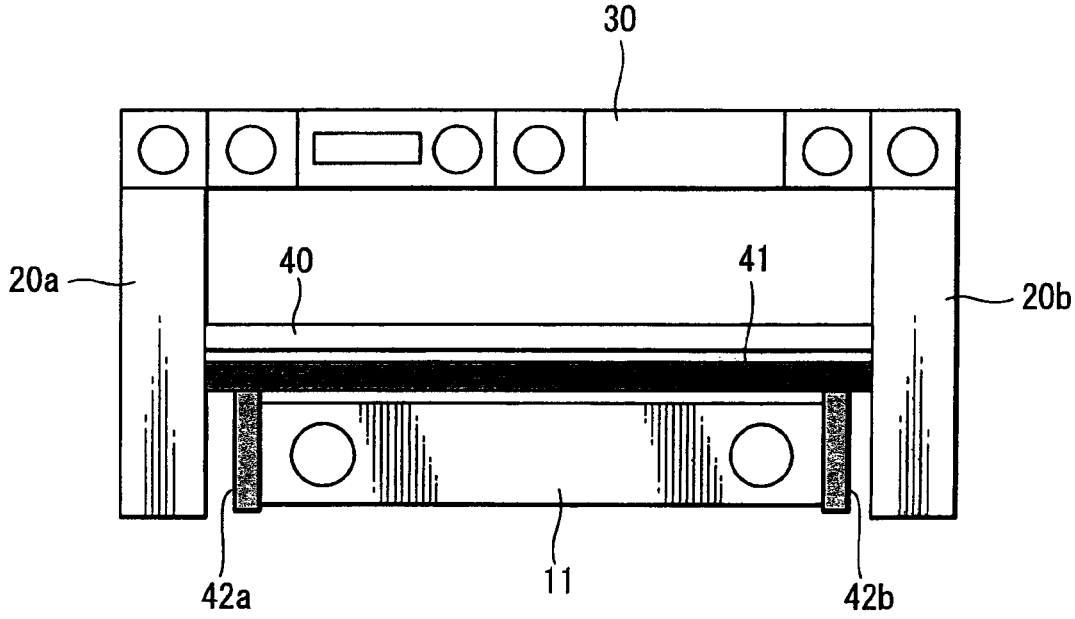
FIG. 8 is a front view illustrating an example of attaching a subwoofer box according to an embodiment of the present invention.

Next, an example of joining of the subwoofer box 11 to the shelf board portion 40 will be described with reference to FIG. 8. As shown in FIG. 8, a reinforcement member 41 as a structure to increase the strength of the AV rack 100 is provided under the shelf board portion 40. The subwoofer box 11 is suspended and held using subwoofer holding portions 42*a*, 42*b* attached to the reinforcement member 41.

As described above, the subwoofer box 11 is not directly joined to the leg portions 20*a*, 20*b*. Therefore, vibrations generated at the subwoofer unit in the subwoofer box 11 may be suppressed so as not to reach to an audio apparatus or the like arranged on the AV rack 100 or stored therein.

Figure 9:
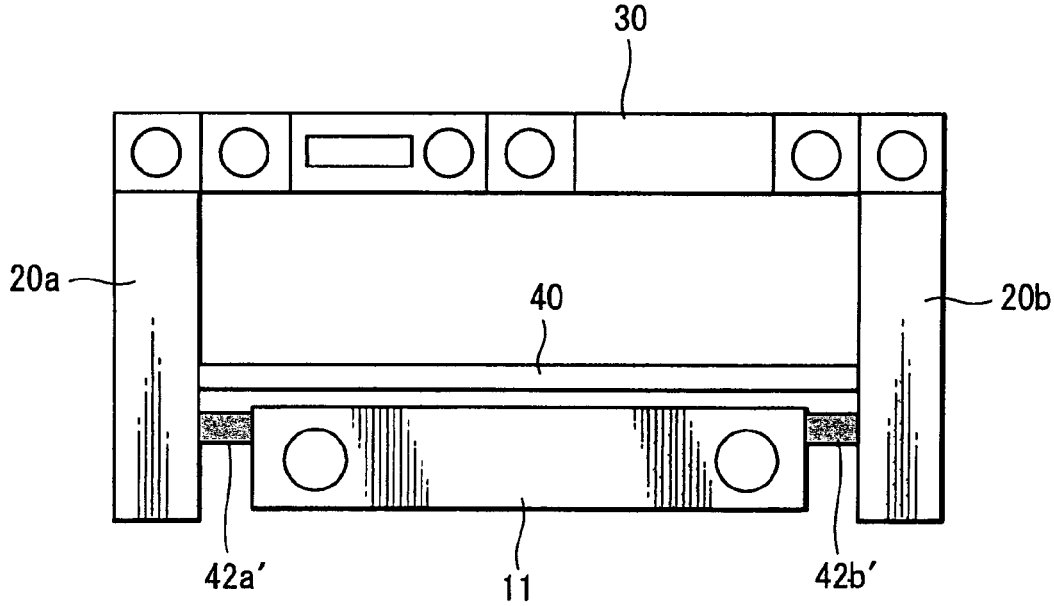
FIG. 9 is a front view illustrating an example of attaching a subwoofer box according to another embodiment of the present invention.

Alternatively, as shown in FIG. 9, subwoofer holding portions 42*a*', 42*b*' alone may hold the subwoofer box 11. According to this embodiment, the subwoofer box 11 is supported by the subwoofer holding portions 42*a*', 42*b*' fixed to the leg portions 20*a*, 20*b* respectively. Basically, a speaker box such as the subwoofer box 11 is a structure having the strength, so that the subwoofer box 11 and the subwoofer holding portions 42*a*', 42*b*' may serve as a part of the structure of the AV rack 100. Accordingly, there may be no need to provide a structure to reinforce the AV rack 100 separately and therefore manufacturing costs for the AV rack 100 may be reduced.

In the case of using such strength inherent to a speaker box such as the subwoofer box 11 so that the speaker box serves as a part of the structure of the AV rack 100, other members than the subwoofer box 11 may be arranged under the shelf board portion 40. Specifically, another speaker box storing the center speaker or the like may be arranged.

Figure 10:
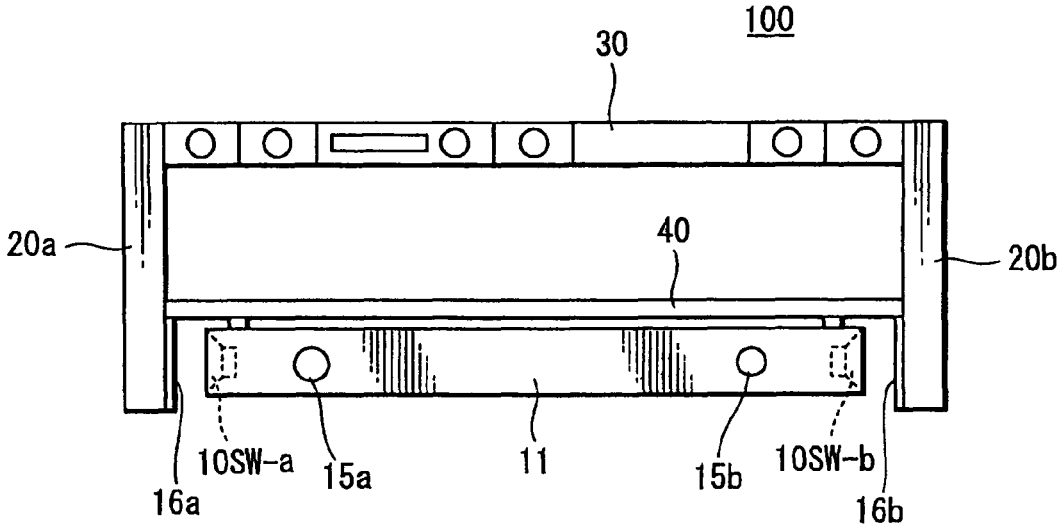
FIG. 10 is a front view illustrating a position where a subwoofer unit is attached according to another embodiment of the present invention.

It should be noted that the subwoofer units 10SW-*a*, 10SW-*b* are arranged on the front surface according to the above-described embodiment. However, as shown in FIG. 10, the subwoofer units 10SW-a, 10SW-b may be arranged on the side surfaces, facing in opposite directions. In this case, reflecting plates 16*a*, 16*b* are provided on the side surfaces of the leg portions 20*a*, 20*b* so that the sound output from the subwoofer units 10SW-*a*, 10SW-*b* can be reflected in the direction of the user. Further, in this case, if bass reflex ports 15*a*, 15*b* are arranged on the front surface, sound in the low frequency band can be output in the direction of the user.

In addition, according to the above-described embodiment, other speaker units than the subwoofer units are incorporated in the top board portion 30. However, an embodiment according to the present invention may be applied to an AV rack 100 including the subwoofer alone. The structure of an AV rack in this case will be described with reference to FIG. 11.

Figure 11:
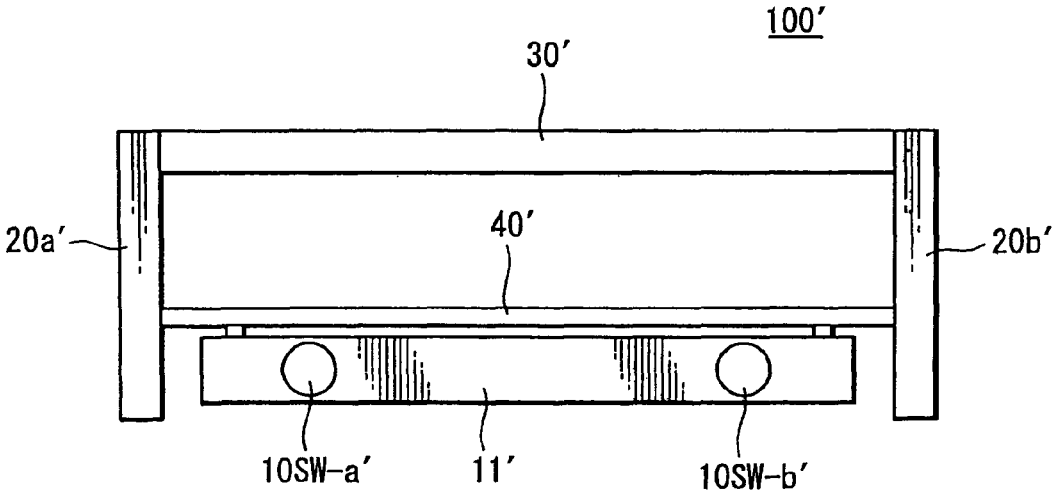
FIG. 11 is a front view illustrating a structure of an AV rack according to another embodiment of the present invention.

Similar to the heretofore described AV rack 100 according to the embodiment, an AV rack 100' shown in FIG. 11 includes a top board portion 30' on which a television receiver or the like is arranged and which is held by leg portions 20*a*', 20*b*' at both ends thereof. A subwoofer box 11' including subwoofer units 10SW-*a*', 10SW-*b*' is provided under a shelf board portion 40' extending between the leg portions 20*a*', 20*b*'.

Accordingly, the AV rack 100' shown in FIG. 11 only includes the subwoofer box 11'. According to the AV rack 100', the sound in other frequency band than a reproduction frequency band of the subwoofer units 10SW-*a*', 10SW-*b*' is output from speakers of other apparatus such as a television receiver (not shown in FIG. 11) provided on the AV rack 100'.

Further, in the case where surround sound of 5.1 or more channels may not be reproduced, a subwoofer is added as an independent unit to expand the range of sound. In this case, a comparatively large subwoofer box may need to be arranged in an appropriate position in the room. If the AV rack 100' incorporating the subwoofer box 11' as shown in FIG. 11 is used, sound of a low frequency band that is not reproduced using a typical speaker unit can be reproduced.

Further, as shown in FIGS. 8 and 9, according to the above-described embodiment of the present invention, the subwoofer box 11 is fixed to the reinforcement member 41 and the leg portions 20*a*, 20*b* using the subwoofer holding portions 42*a*, 42*b*. However, the subwoofer box 11 may be directly fixed to the shelf board portion 40 using the subwoofer holding portions 42*a*, 42*b*.

Further, according to the above-described embodiment of the present invention, two holding portions to hold the subwoofer box 11 are provided on the right and left respectively. However, the number of holding portions is not limited thereto. The subwoofer box 11 may be held using three or more portions.

Furthermore, according to the above-described embodiment of the present invention, the front surface of the speaker unit including the subwoofer is exposed. However, a speaker cloth may be provided to cover the front surface.

Moreover, the leg portions 20*a*, 20*b* may be used as a pressure board.

It should be understood by those skilled in the art that various modifications, combinations, sub-combinations and alterations may occur depending on design requirements and other factors insofar as they are within the scope of the appended claims or the equivalents thereof.

What is claimed is:

1. A storage rack capable of storing an audio apparatus, comprising:

a top board portion supporting the audio apparatus;

at least two leg portions holding the top board portion;

a shelf board portion vertically joined to a side surface of the respective leg portions and in parallel with the top board portion with an adjustable distance thereto;

a speaker storage portion arranged under the shelf board portion, and a reinforcement portion arranged under the shelf board portion and configured to reinforce the strength of the storage rack, wherein the speaker storage portion is suspended from the reinforcement portion at a position having a predetermined distance in the depth direction of the shelf board portion.

2. A storage rack according to claim 1, further comprising a blind screen provided below a front surface of the shelf board portion for hiding the speaker storage portion.

3. A storage rack according to claim 1, further comprising:

an amplifier portion amplifying an audio signal output from the audio apparatus; and speakers emitting audio signals amplified in the amplifier portion, wherein a subwoofer arranged as one of the speakers is stored in the speaker storage portion arranged under the shelf board portion.

4. A storage rack according to claim 1, wherein a sound emitting surface of a sound emitting portion of the speaker storage portion is arranged on a front surface thereof.

5. A storage rack according to claim 1, wherein the speaker storage portion includes a plurality of speakers, sound emitting surfaces of which are directed in opposite directions.

6. A storage rack according to claim 5, further comprising at least two reflecting plates disposed on the at least two leg portions such that sound output from the plurality of speakers is reflected in a direction of a user.

7. A storage rack according to claim 1, wherein the predetermined distance is determined such that the speaker storage portion is not visible by a user standing in front of the storage rack.

* * * * *